United States Patent [19]

Humphries et al.

[11] Patent Number: 4,632,010

[45] Date of Patent: Dec. 30, 1986

[54] AIRBOC CHAFF DEPLOYMENT SYSTEM

[75] Inventors: Waymon Humphries, Beltsville, Md.; John Bryant, Woodbridge; Richard C. Eklund, Alexandria, both of Va.; Donald C. Hayes, Waldorf; Peter Ferko, Rockville, both of Md.

[73] Assignee: The United States of America as represented by the Secretary of the Navy, Washington, D.C.

[21] Appl. No.: 718,399

[22] Filed: Apr. 1, 1985

[51] Int. Cl.[4] ..... F42B 13/04; F42B 25/02

[52] U.S. Cl. ..... 89/1.51; 89/1.55; 102/387

[58] Field of Search ..... 102/505, 387, 340, 357; 89/1.55, 1.51; 343/18 E

[56] References Cited

U.S. PATENT DOCUMENTS

| | | | |
|---|---|---|---|
| 2,686,025 | 8/1954 | Klas | 102/387 X |
| 3,066,632 | 12/1962 | Bemis | 102/387 X |
| 3,502,023 | 3/1970 | Britton | 102/340 |
| 3,715,668 | 2/1973 | Herring et al. | 102/387 X |
| 4,013,009 | 3/1977 | Claude et al. | 102/340 X |
| 4,183,302 | 1/1980 | Schillreff | 102/505 X |
| 4,226,185 | 10/1980 | Tobler et al. | 102/340 |
| 4,367,680 | 1/1983 | Hart | 102/387 |
| 4,372,215 | 2/1983 | Crepin | 102/387 |
| 4,423,660 | 1/1984 | Ovellete | 89/1.51 |

*Primary Examiner*—David H. Brown

*Attorney, Agent, or Firm*—Sol Sheinbein; Ansel M. Schwartz

[57] ABSTRACT

An AIRBOC chaff deployment apparatus comprising a canister with a wind flap attached externally to the canister and connected to a drogue chute that is housed inside the canister. The drogue chute is situated atop a main chute that is atop a release mechanism, which is atop a fuze and that is atop a chaft payload, all of which is housed inside the canister. When the AIRBOC is dropped from a plane, the wind flap extends, pulling out the drogue chute. The drogue chute in turn activates the release mechanism which frees the drogue chute to pull out the main chute to which the drogue chute is connected. The deployment of the main chute causes a force greater than 40 lbs to be applied to the release mechanism, resulting in the chaff payload being released from the canister and the fuze being activated, consequently detonating the released chaff payload.

8 Claims, 7 Drawing Figures

SECTION A-A

AIRBOC CHAFF DEPLOYMENT SYSTEM

BACKGROUND OF THE INVENTION

The present invention is related to an Air Rapid Bloom Offboard Chaff (AIRBOC) deployment system which has a minimal chance of pre-maturely detonating.

An AIRBOC system is useful as a countermeasure against threats, such as ASMS and targeting radars, which could identify, locate and possibly destroy a ship. A typical AIRBOC system performs its function by being dropped from an aircraft and after a set delay, detonates at a safe distance from the aircraft. More specifically, shortly after the AIRBOC is dropped from the aircraft and at the desired altitude, the AIRBOC is exploded, releasing a cloud of chaff into the area. The chaff is detected by enemy weapon systems and causes attention to be directed to it rather than the ship.

One problem that exists in AIRBOC is the potential for premature detonation resulting in serious injury to crewmen loading or transporting the AIRBOC. All to often during loading or transport, an AIRBOC is mishandled causing a detonation system to become armed with disasterous consequences.

SUMMARY OF THE INVENTION

Accordingly, one object of the present is to provide an AIRBOC that has minimal chance of becoming armed and subsequently detonating pre-maturely.

Another object of the present invention is to provide an AIRBOC that can only be armed when actual deployment of the AIRBOC occurs.

Another object of the present invention is to provide for an out-of-line explosive train that maintains the explosive system out of the line of the detonator that explodes the AIRBOC until the AIRBOC is deployed and reaches the desired altitude.

Another object of the present invention is to maintain the fuzing system in a safe condition until the main parachute is deployed in relative winds greater than 50 knots, thus preventing inadvertant payload functioning.

These and other objects of the present invention are attained with an AIRBOC chaff deployment apparatus comprising a canister; a chaff payload located inside and at the bottom of the canister; a fuze located inside the canister and connected to and atop the chaff payload, the chaff payload being detonated by the fuze; a release mechanism connected to and located inside the canister and atop of the fuze; the fuze being activated by the release mechanism; a main chute located inside the canister and connected to and atop of the release mechanism; a drogue chute located inside of and at the top of the canister and connected to the release mechanism and connected to and atop of the main chute, the main chute being deployed by the drogue chute, the release mechanism being activated by the main chute and the drogue chute; and a wind flap located outside and alongside the canister and connected at one end to the drogue chute, the drogue chute being deployed by the wind flap.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
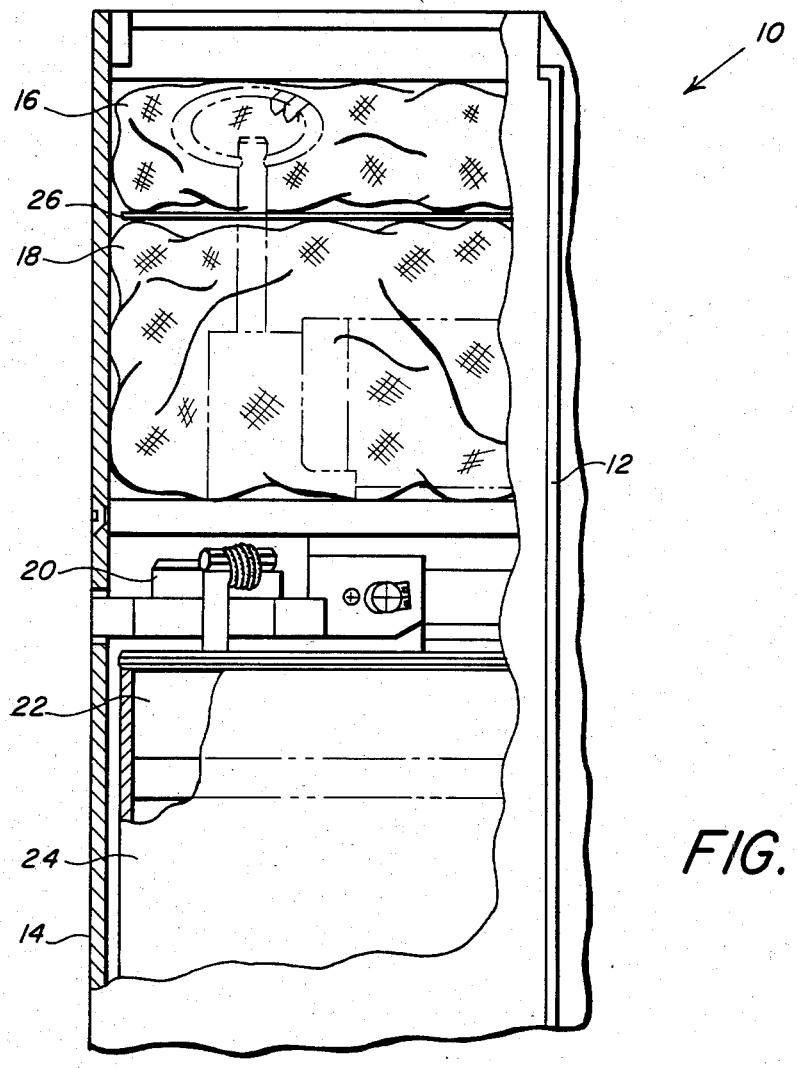
FIG. 1 is a cross-sectional view of the AIRBOC chaff deployment system.

Referring now to the drawings, wherein like reference numerals designate identical or corresponding parts throughout the several views, and more particularly to FIG. 1 thereof, there is shown an AIRBOC chaff deployment system 10. The AIRBOC system is comprised of a wind flap 12 that is mounted on a canister 14. Within the canister 14 is a Drogue chute 16, a Main chute 18, a release mechanism 20, a fuze 22, and a chaff payload 24. The Drogue chute 16 is located atop the Main chute 18 and is separated by a separator 26. The Main chute 18 is located atop the release mechanism 20 which in turn is located atop the fuze 22. The fuze 22 is located atop the chaff payload.

When the AIRBOC is launched, the wind flap 12 is pulled out by the wind. This, in turn, pulls drogue chute 16 out of the canister 14, deploying it. After a predetermined delay controlled by the release mechanism 20, the drogue chute 16 is released resulting in the main chute 18 being deployed. The deployment of the main chute 18 causes the release mechanism to separate the chaff payload 24 from the canister 14. Upon separation, the fuze 22 is activiated, consequently detonating the chaff payload.

Figure 2:
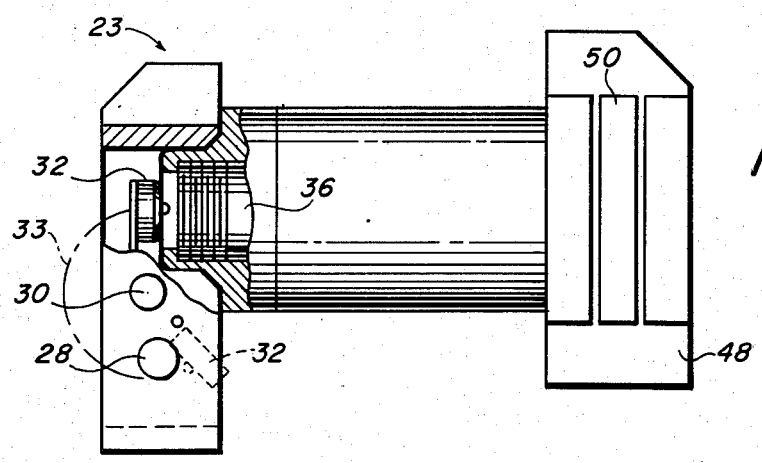
FIG. 2 is a top view of the release mechanism fuze assembly of the release mechanism.
Figure 3:
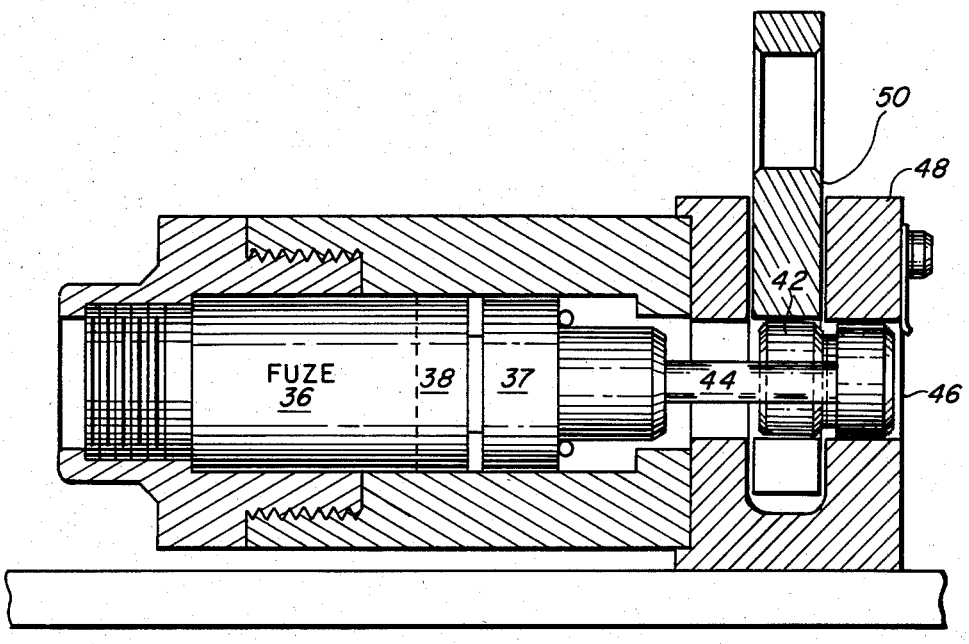
FIG. 3 is a side view of the release mechanism fuze assembly of the release mechanism.
Figure 4:
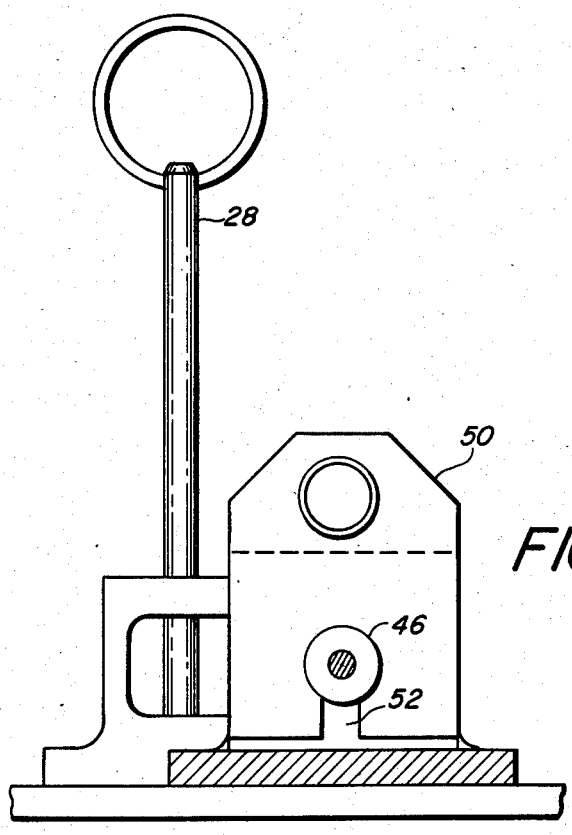
FIG. 4 is a front view of the release mechanism fuze assembly of the release mechanism.
Figure 5:
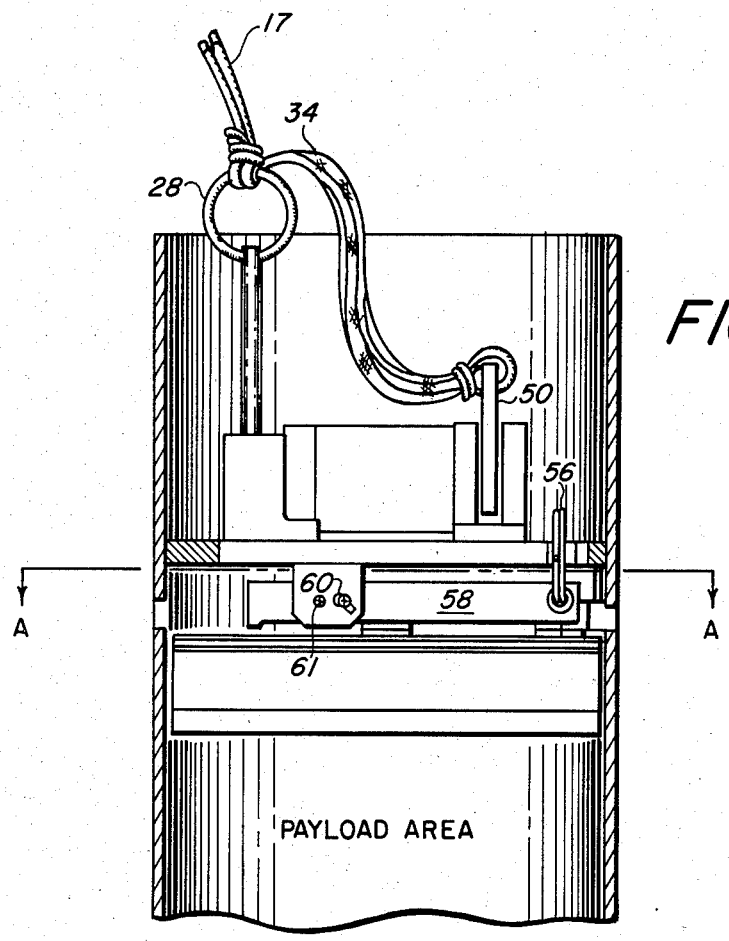
FIG. 5 is a side view of the release mechanism.

Referring to FIGS. 2, 3, and 4, there is disclosed a more detailed depiction of the top, side, and front view of a release mechanism fuze assembly 23 of the release mechanism 20, respectively. FIG. 2 shows a release pin 28 and a pivot pin 30 which has a grenade firing pin 32 connected to it. A release pin 28 has Drogue shroud lines 34 (see FIG. 5) tied to it so that when the Drogue chute 16 deploys through the pulling action of the wind flap 12 that it is connected to, the release pin 28 is pulled out of its position. Removal of the release pin 28 frees a grenade firing pin 32, which is spring loaded, to pivot around the pivot pin 30 along a grenade firing pin path 33 and strike a release mechanism fuze 36 which is contact activated, thus igniting it. (The grenade firing pin path 33 is defined by an arc length starting at the location where the grenade firing pin 32 is originally cocked and held in place by the release pin 28, and ending at the point where the grenade firing pin 32 strikes the release mechanism fuze 36 after the grenade firing pin 32 is freed. The center of curvature of the arc length is located where the pivot pin 30 is seated.) The release mechanism fuze 36 has a full burn time of approximately 4 seconds, as it burns it forces a piston 37 made of a plunger 42 connected to a connecting cylinder 44 to move forward through a hole 46 in a piston latch 48. The movement of the piston assembly 37 frees the Drogue chute clip 50 and consequently the Drogue chute 16 from the AIRBOC system.

The movement of piston 37 can more clearly be seen by referring to FIG. 4 which better shows the hole 46 with an insert 52. The insert 52 has a smaller width than the diameter of the hole 46 and of the plunger 42 that rests in the hole 46 in the undetonated position, thus preventing a drogue chute clip 50 from pulling away under the force of the drogue chute shroud lines 34. As mentioned above, when the release mechanism explosive charge is detonated, the piston assembly 37 slides forward. This causes the connecting cylinder 44 to come to rest where the plunger 42 used to be and the plunger 42 to be pushed through the hole 46 and to come to rest outside of the hole 46. Since the diameter of the connecting cylinder 44 is smaller than the width of the insert 52 there is no longer any impedment for the Drogue chute clip 50 to separate from the AIRBOC system. Consequently, the Drogue chute clip 50 is pulled out from the AIRBOC allowing the drogue chute 16 to completely deploy.

Figure 6:
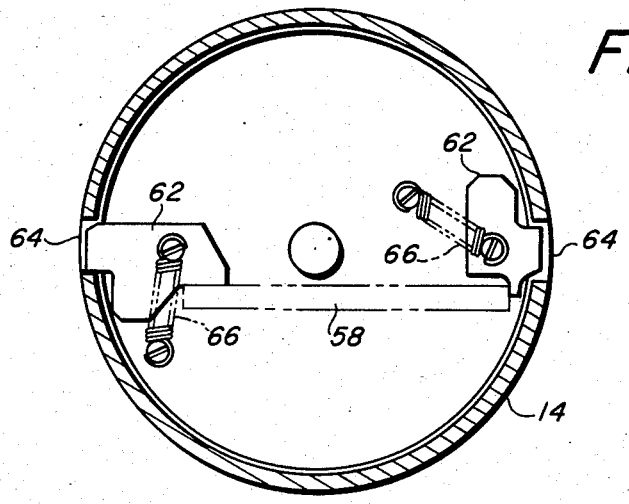
FIG. 6 is a top view of the tabs, tab springs, and main chute lever arm of the release mechanism.

Upon release of the Drogue chute clip 50, which has been delayed for 4 seconds due to the above mechanism, a Main chute bag is pulled off of the Main chute 18 via a Main chute bag line 34 which is connected to the end of the Drogue chute shroud 17. The Main chute 18 then deploys causing a Main chute attachment 56 to be loaded due to the momentum of the AIRBOC system being in a direction opposite to the slowing force of the deploying Main chute 18 (See FIG. 5). The load on the Main chute attachment 56 is in the form of a force that causes a Main chute lever arm 58 to snap a shear pin 60 and rotate counter-clockwise around rotation pin 61. (The shear pin 60 will not snap unless a force greater than 40 lbs is applied to the main chute lever arm 58.) This in turn releases tabs 62 which are attached to the top of the chaff payload 24 and hold the chaff payload 24 secure in the canister 14 by extending into canister slots 64 (See FIG. 6). The tabs 62 are spring loaded and are pulled out of the canister slots by tab springs 66 when the Main chute lever arm 58 is pulled up causing the pressure, holding the tabs 62 in place, to be removed.

Figure 7:
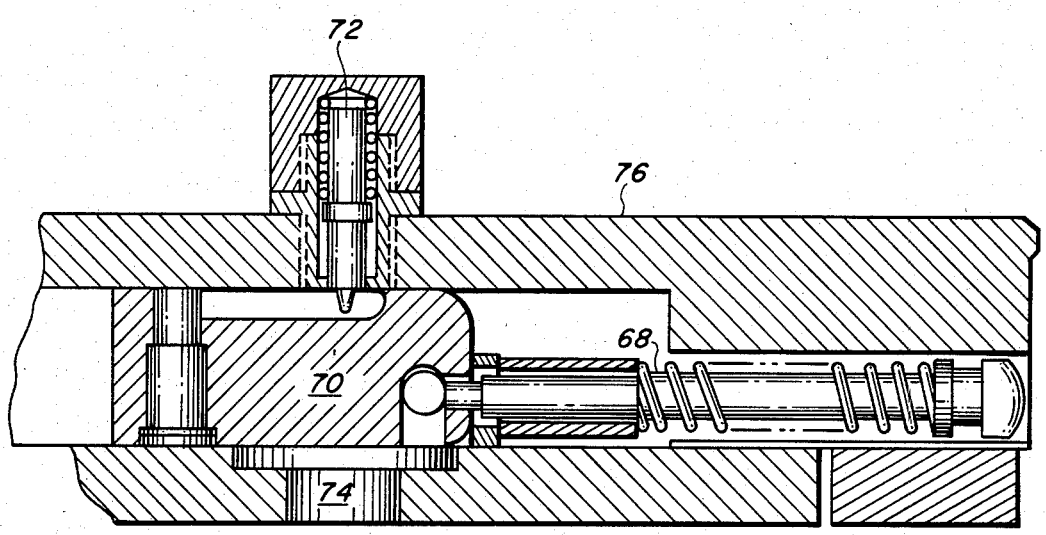
FIG. 7 is a cross-sectional view of the fuze.

With the release of the tabs 62, the chaff payload 24 slides out of the bottom of cannister 14 because of its downward momentum being opposite to the force on the canister 14 due to the deploying main chute. As the chaff payload 24 slides out of the canister 14, a spring loaded bore rider 68, which had been held in place by the canister 14, releases (See FIG. 7). The release of the bore rider 68 in turn causes the clearance hole in the stab detonator assembly 70 to become positioned directly below a firing pin 72. The firing pin 72 is spring loaded and as soon as the stab detonator assembly comes to rest under the firing pin 72, the firing pin 72 slides through the stab detonator assembly 70 and strikes the chaff payload detonator 74. The chaff payload detonator 74 is contact sensitive and explodes when the firing pin 72 strikes it, resulting in chaff being dispursed in all directions.

Obviously, numerous (additional) modifications and variations of the present invention are possible in light of the above teachings. It is therefore to be understood that within the scope of the appended claims, the invention may be practiced otherwise than as specifically described herein.

What is claimed and desired to be secured by Letters Patent of the United States is:

1. An AIRBOC chaff deployment appartus comprising:

a canister;

a chaff payload located inside and at the bottom of said canister;

a fuze located inside said canister and connected to and atop said chaff payload, said chaff payload adapted to being detonated by said fuze;

a release mechanism connected to and located inside said canister and atop of said fuze; said fuze being activated by said release mechanism;

a main chute located inside said canister and connected to and atop of said release mechanism;

a drogue chute located inside of and at the top of said canister and connected to said release mechanism and connected to and atop of said main chute, said main chute being deployed by said drogue chute, said release mechanism being activated by said main chute and said drogue chute; and a wind flap located outside and alongside said canister and connected at one end to said drogue chute, said drogue chute being deployed by said wind flap.

2. An AIRBOC chaff deployment apparatus as described in claim 1, wherein the release mechanism comprises: means for delaying the deployment of the drogue chute; means for activating the delay means; and means for releasing the fuze only after the drogue chute is deployed;

and wherein the fuze comprises means for detonating the chaff payload after the chaff payload has become free from the canister; and means for holding the detonating means and the chaff payload in the canister until the release mechanism releases the chaff payload and detonating means.

3. An AIRBOC chaff deployment apparatus as described in claim 1, wherein the release mechanism comprises means for delaying the deployment of the drogue chute; and means for activating the fuze only after the drogue chute is deployed.

4. An AIRBOC chaff deployment apparatus as described in claim 3, wherein said release mechanism comprises:

a release pin that is connected to said drogue chute;

a grenade firing pin;

a release mechanism fuze, said release pin being located next to a grenade firing pin path, said path being defined by an arc length greater than 180 degrees between said grenade firing pin and said release mechanism fuze;

a pivot pin positioned at the center of curvature of the grenade firing pin path, said grenade firing pin being attached to said pivot pin;

a release mechanism explosive charge attached to said release mechanism fuze, said release mechanism fuze being situated between said release mechanism explosive charge and said release mechanism end of said grenade firing pin path;

a piston comprised of a cylinder and a plunger, said piston cylinder being attached to said release mechanism explosive charge, said release mechanism explosive charge situated between said piston and said release mechanism fuze;

a drogue chute clip with an insert and a hole, said piston plunger resting in said hole, said insert being located in said drogue chute clip below where said piston plunger rests and running the length from where said piston plunger rests to the bottom of said drogue chute clip, said insert being smaller in width than the diameter of said piston plunger but larger in width than the diameter of said piston cylinder, said drogue chute clip being connected to said drogue chute at the top of said clips, and wherein said drogue chute is also connected to said fuze activating means which comprises said main chute;

a main chute lever arm;

a main chute attachment adapted to being connected at one end to said main chute and attached at the other end to said main chute lever arm; and a rotator pin, the end of said main chute lever arm not attached to said main chute attachment being attached to said rotator pin and pivoting therearound when a force greater than 40 lbs. is applied through said main chute attachment to the main chute lever arm, said main chute lever arm being located above said fuze and preventing said fuze from activating as long as no force greater than 40 lbs. is applied to said main chute attachment.

5. An AIRBOC chaff deployment apparatus as described in claim 1, wherein the fuze comprises: means for detonating the chaff payload after the chaff payload has become free from the canister; and means for holding the detonating means and the chaff payload in the canister until the release mechanism releases the chaff payload and detonating means.

6. An AIRBOC chaff deployment apparatus as described in claim 5, wherein said means for detonating said chaff payload comprises:

a housing;

a chaff payload detonator located in the base of said housing;

a firing pin located inside and at the top of said housing and above said chaff payload detonator, said chaff payload detonator being detonated by said firing pin;

a stab detonator having a channel, said stab detonator being located inside said housing and between said firing pin and said chaff payload detonator, said firing pin being activated by said stab detonator;

a bore rider being located inside said housing and having one end alongside and connected to said stab detonator and said bore rider's other end extending out of said housing and pressing against said canister, said stab detonator being activated by said bore rider, said bore rider being activated by said chaff payload separating from said canister; and said holding means being seated outside of and on top of said housing and comprising a first tab;

a second tab located diametrically opposite said first tab;

a first canister slot; and a second canister slot located in said canister diametrically opposite said first canister slot and level with said first and second tabs, said first tab having one side inserted into said first canister slot and said second tab having one side inserted into said second canister slot.

7. A method for detonating an AIRBOC comprising the steps of:

deploying a drogue chute;

delaying deployment of a main chute for a predetermined period of time;

deploying the main chute;

releasing a chaff payload from the AIRBOC when at least 40 lbs. of force are applied to a release mechanism in the AIRBOC by the main chute;

separating the chaff payload from the AIRBOC, detonating the chaff payload.

8. A method as described in claim 7 where the detonating step includes the steps of:

releasing a bore rider; and moving a stab detonator assembly in place so a firing pin can strike a chaff payload detonator and detonate the chaff payload.

* * * * *